US012733736B2

(12) United States Patent
van Til et al.

(10) Patent No.: US 12,733,736 B2
(45) Date of Patent: Sep. 15, 2026

(54) SENSORY SEAT

(71) Applicants: Ronald Andrew van Til, Houston, TX (US); Rachel Lynn Stevenson, Houston, TX (US)

(72) Inventors: Ronald Andrew van Til, Houston, TX (US); Rachel Lynn Stevenson, Houston, TX (US)

( * ) Notice: Subject to any disclaimer, the term of this patent is extended or adjusted under 35 U.S.C. 154(b) by 123 days.

(21) Appl. No.: 18/763,937

(22) Filed: Jul. 3, 2024

(65) Prior Publication Data

US 2025/0024947 A1 Jan. 23, 2025

Related U.S. Application Data

(60) Provisional application No. 63/513,911, filed on Jul. 17, 2023.

(51) Int. Cl.

| | |
|---|---|
| ***A47C 3/025*** | (2006.01) |
| ***A47C 7/50*** | (2006.01) |
| ***A47D 13/10*** | (2006.01) |
| ***A63G 9/12*** | (2006.01) |
| ***A63G 13/02*** | (2006.01) |

(52) U.S. Cl.

CPC ..... *A47C 3/0252* (2013.01); *A47C 7/50* (2013.01); *A47D 13/105* (2013.01); *A47D 13/107* (2013.01); *A63G 9/12* (2013.01); *A63G 13/02* (2013.01)

(58) Field of Classification Search

CPC ..... A47C 3/0252; A47C 7/50; A47C 3/0255; A47D 13/105; A47D 13/107; A47D 1/00; A63G 9/12; A63G 13/02

USPC ..... 472/118; 297/260.1, 273, 277, 281, 297/344.1, 344.11, 423.1, 423.4

See application file for complete search history.

(56) References Cited

U.S. PATENT DOCUMENTS

| | | | | | |
|---|---|---|---|---|---|
| 43,420 | A * | 7/1864 | McDougall | A63G 9/00 | 472/118 |
| 262,447 | A * | 8/1882 | Mason | A47C 3/0255 | 297/487 |
| 859,212 | A * | 7/1907 | Gerthoffer | A63G 9/16 | 472/124 |
| 872,736 | A * | 12/1907 | Lansberry | A47C 3/0255 | 297/411.44 |
| 959,085 | A * | 5/1910 | Virgie | A47C 3/0255 | 5/124 |
| 1,189,393 | A * | 7/1916 | Shaw | A47D 13/105 | 297/277 |
| 1,198,912 | A * | 9/1916 | Haberacker | A47C 1/035 | 297/359 |
| 1,397,201 | A * | 11/1921 | Bebry | A47C 3/0255 | 5/124 |
| 1,478,768 | A * | 12/1923 | Schwartz | A47C 3/0255 | 297/133 |

(Continued)

*Primary Examiner* — Robert Canfield

(57) ABSTRACT

A sensory seat having a seat portion, a support structure, and a plurality of connection members. The seat portion is suspended from the support structure, being held in suspense via the plurality of connection members. The connection members allow the seat portion to move multi-directionally relative to the support structure. The support structure is composed of two support members and may be outfitted to receive a footrest. The foot rest may be adjustable in height given multiple receiver slots cut into the support members.

18 Claims, 4 Drawing Sheets

(56) References Cited

U.S. PATENT DOCUMENTS 1,640,274 A * 8/1927 Hall ..... A63G 9/00 403/209
2,048,110 A * 7/1936 Fry ..... A47D 13/105 472/120
D140,217 S * 1/1945 Skolnik ..... 297/464
2,547,891 A * 4/1951 Smith ..... A47C 3/0255 5/124
2,601,887 A * 7/1952 Petersen ..... A47D 13/105 472/122
2,697,477 A * 12/1954 Welsh ..... A47D 13/107 297/130
4,452,446 A * 6/1984 Saint ..... A47D 13/105 472/119
4,456,244 A * 6/1984 Andrews ..... A63G 9/00 472/125
D294,375 S * 2/1988 Lowry ..... D21/521
D305,584 S * 1/1990 Spilman ..... D6/334
5,238,291 A 8/1993 Alionis
5,538,324 A 7/1996 Haber-Shomaker
5,803,818 A * 9/1998 Tseng ..... A47C 3/0255 472/125
5,842,741 A * 12/1998 Onorini ..... A47C 3/0255 472/125
5,857,944 A * 1/1999 Cone ..... A47D 13/107 482/121
6,089,654 A 7/2000 Burstein
6,120,094 A * 9/2000 Parent ..... A47C 3/03 297/270.3
6,343,838 B1 * 2/2002 Bagshaw ..... A63G 9/00 297/278
6,582,018 B2 * 6/2003 Tseng ..... A47C 3/0255 297/280
6,739,662 B1 * 5/2004 Alvarez ..... A47C 1/0342 297/423.37
6,767,059 B1 * 7/2004 Rhoades ..... A47D 13/107 297/277
6,854,800 B2 2/2005 Perego
6,932,709 B1 * 8/2005 Gubitosi ..... A47D 13/101 297/274
6,951,369 B1 * 10/2005 Wang ..... A47C 3/0255 297/281
6,994,630 B2 * 2/2006 Paesang ..... A47D 13/105 472/120
7,040,995 B2 5/2006 Lee
7,258,618 B2 * 8/2007 Haut ..... A47D 13/105 472/119
D670,925 S * 11/2012 Slayton ..... D6/344
8,684,458 B2 * 4/2014 Lee ..... A47C 7/407 297/277
8,702,526 B2 * 4/2014 Myers ..... A47D 1/10 472/118
10,306,987 B2 * 6/2019 Kim ..... A47C 11/00
10,455,942 B2 * 10/2019 Chen ..... A47C 4/02
10,625,169 B1 * 4/2020 Mayer ..... A63G 9/10
10,631,643 B2 4/2020 Lin et al.
10,779,660 B2 * 9/2020 Zou ..... A47D 13/101
11,344,125 B1 * 5/2022 Sun ..... A47C 4/028
11,547,201 B1 * 1/2023 Sun ..... A47C 3/026
11,659,932 B2 * 5/2023 Frankel ..... A47C 3/0255 297/16.2
D1,052,285 S * 11/2024 Dong ..... D6/347
2004/0065360 A1 * 4/2004 Lin ..... A47C 7/66 135/96
2004/0135408 A1 * 7/2004 Noll ..... A47C 7/66 297/281
2005/0173949 A1 * 8/2005 Hart ..... A47C 3/0255 297/171
2006/0111194 A1 * 5/2006 Dillner ..... A47D 9/057 472/119
2012/0178544 A1 * 7/2012 Horst ..... A47D 9/012 472/118
2013/0005493 A1 * 1/2013 Kim ..... A47C 3/0255 472/118
2013/0033075 A1 * 2/2013 Lee ..... A47C 7/407 297/184.1
2013/0288811 A1 * 10/2013 Huntsberger ..... A47D 9/005 297/135
2016/0206096 A1 * 7/2016 Chen ..... A47C 7/66
2018/0289161 A1 * 10/2018 Kim ..... A61B 5/1118
2019/0038028 A1 * 2/2019 Pacific ..... A47C 4/02
2023/0294005 A1 * 9/2023 Kufel ..... A63G 9/12 472/118
2025/0089894 A1 * 3/2025 Shen ..... A45F 3/26

* cited by examiner

SENSORY SEAT

FIELD OF THE INVENTION

The present invention relates generally to chairs and furniture. More specifically, the present invention is a sensory chair allowing for movement while seated.

BACKGROUND OF THE INVENTION

Sensory devices are commonly used by children and adults with autism, ADHD, anxiety, and/or sensory processing disorders to help the user focus, whether at home, school, work, or in other areas of their life. Specifically, sensory chairs allow for movement while seated to stay active and focused without getting up from a seat. However, many sensory chairs utilize balance balls, uneven rocking supports/legs, or rotating seats. While these types of chairs are useful in allowing the user to move while seated, they are not suitable for all users, particularly younger users who may fall from the chair or tip the chair.

On objective of the present invention is provide a sensory chair that may position a user in a 90-90 configuration wherein the torso of the user is at a 90° angle relative to their thighs while their knees are bent at a 90° angle. An additional objective of the present invention is to allow the user to stand on the foot plate, essentially allowing the user to move around while maintaining contact with the sensory chair. The present invention seeks to overcome the above referenced shortcomings of the prior art by providing a sensory chair with a stable frame that allows for a wide range of movement from the seated position, whether at a dining table, desk, or other location.

SUMMARY OF THE INVENTION

A sensory seat having a support structure, a seat portion and a plurality of connection members. The seat portion swings from the support structure by means of the connection members, thereby allowing multi-directional movement of the seat portion.

DETAIL DESCRIPTIONS OF THE INVENTION

Figure 1:
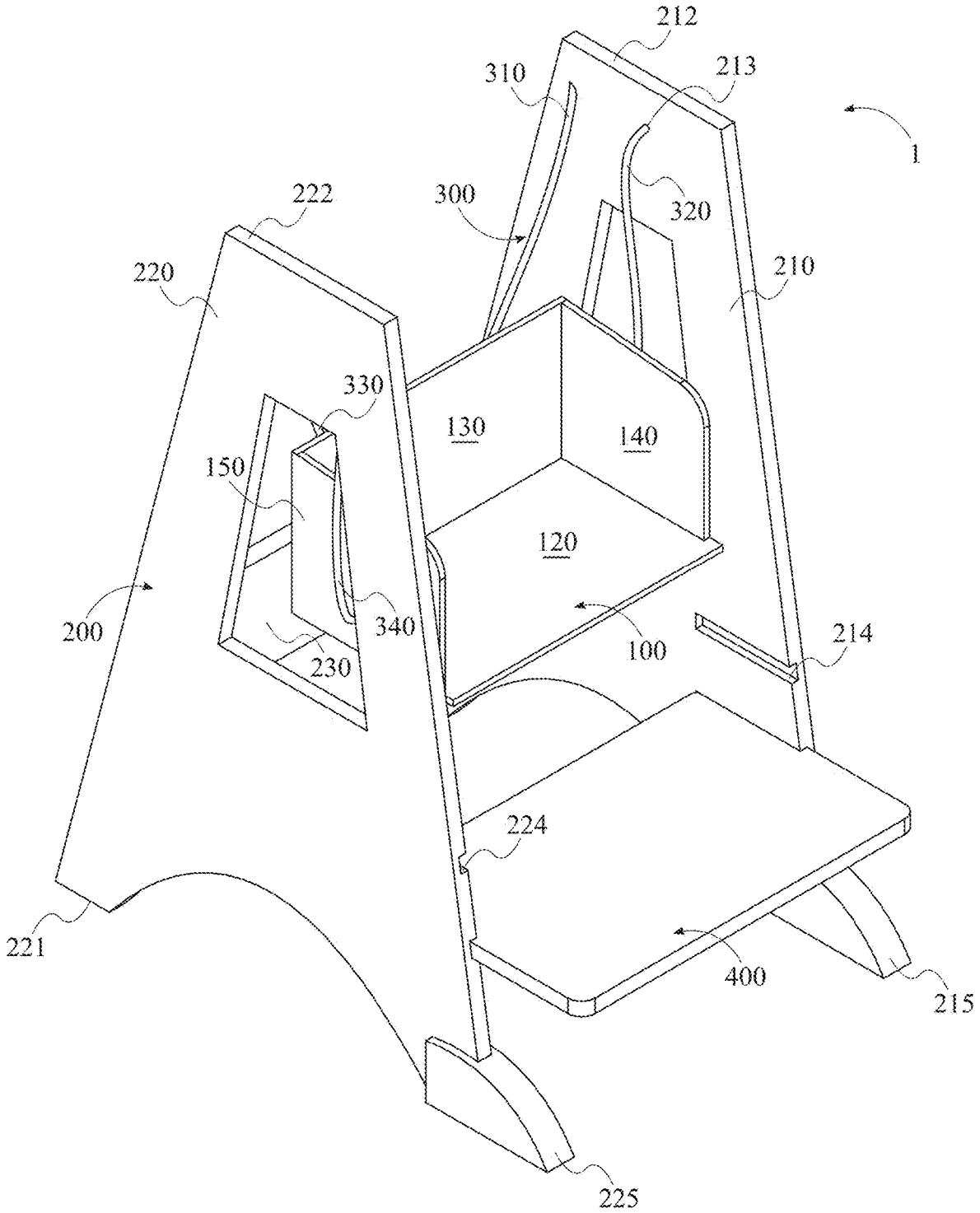
FIG. 1 is a top perspective view of the present invention.

All illustrations of the drawings are for the purpose of describing selected versions of the present invention and are not intended to limit the scope of the present invention.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term-differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

Other technical advantages may become readily apparent to one of ordinary skill in the art after review of the following figures and description. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise indicated, the drawings are intended to be read together with the specification, and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure as the particular drawing figure faces the reader. Similarly, the terms "inwardly," "outwardly" and "radially" generally refer to the orientation of a surface relative to its axis of elongation, or axis of rotation, as appropriate.

The present disclosure includes many aspects and features. Moreover, while many aspects and features relate to, and are described in the context of a sensory seat 1, embodiments of the present disclosure are not limited to use only in this context.

As shown in FIG. 1 through FIG. 4, the present invention is a sensory seat 1 comprising a seat portion 100, a support structure 200, and a plurality of connection members 300. In the preferred embodiment of the present invention, the seat portion 100 is mounted to the support structure 200 via the plurality of connection members 300. In the context of the present invention, each of the plurality of connection members 300 are composed of elongated members comprising a first end and a second end wherein the first end of each of the plurality of connection members 300 is connected to the support structure 200, and the second end of each connection member is connected the seat portion 100. In the context of the present invention, the seat portion 100 of the present invention is suspended from the support structure 200, via the plurality of connection members 300.

In the preferred embodiment of the present invention, the seat portion 100 comprises a seat bottom 120, a seat back 130, a left seat side 140, and a right seat side 150. The left seat side 140 and the right seat side 150 are each connected perpendicular to the seat bottom 120, extending parallel to one another away from the seat bottom 120. The seat back 130 is connected to the seat bottom 120, the left seat side 140, and the right seat side 150, creating a partially enclosed basket structure. The seat back 130 may be positioned perpendicular to the seat bottom 120, though in some embodiments, a seat angle is delineated between the seat bottom 120 and the seat back 130 with the seat angle preferably being an obtuse angle. The seat portion 100 may comprise an internal surface and an external surface. Additionally, the seat portion 100 may comprise a plurality of attachment ports 110. In the preferred embodiment of the present invention, the plurality of attachment ports 110 is located on the seat back 130, the left seat side 140, and the right seat side 150. In the preferred embodiment of the present invention, the seat portion 100 comprises one attachment port on the left seat side 140, one attachment port on the right seat side 150, and two attachment ports on the seat back 130.

Figure 2:
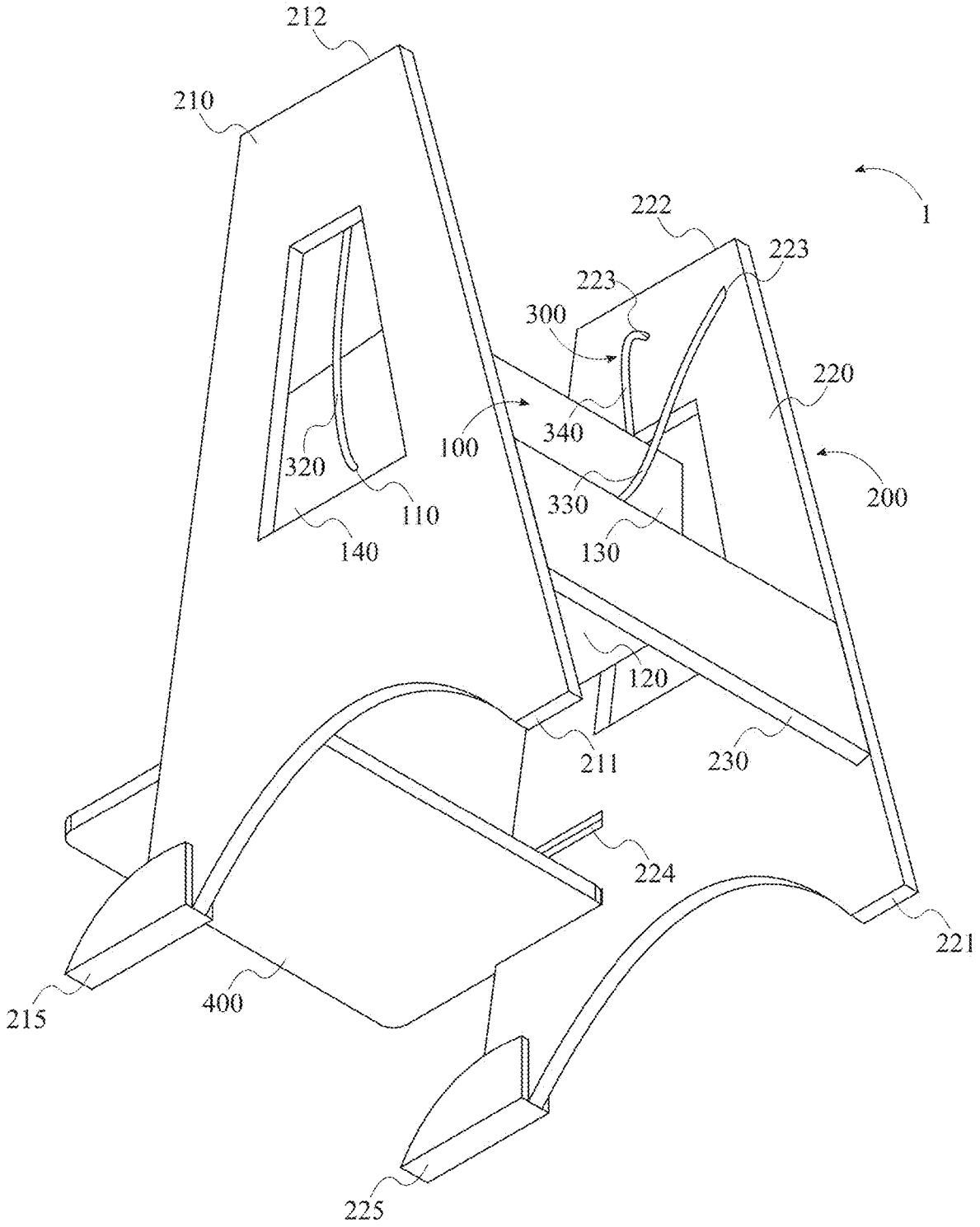
FIG. 2 is a bottom rear perspective view of the present invention.
Figure 3:
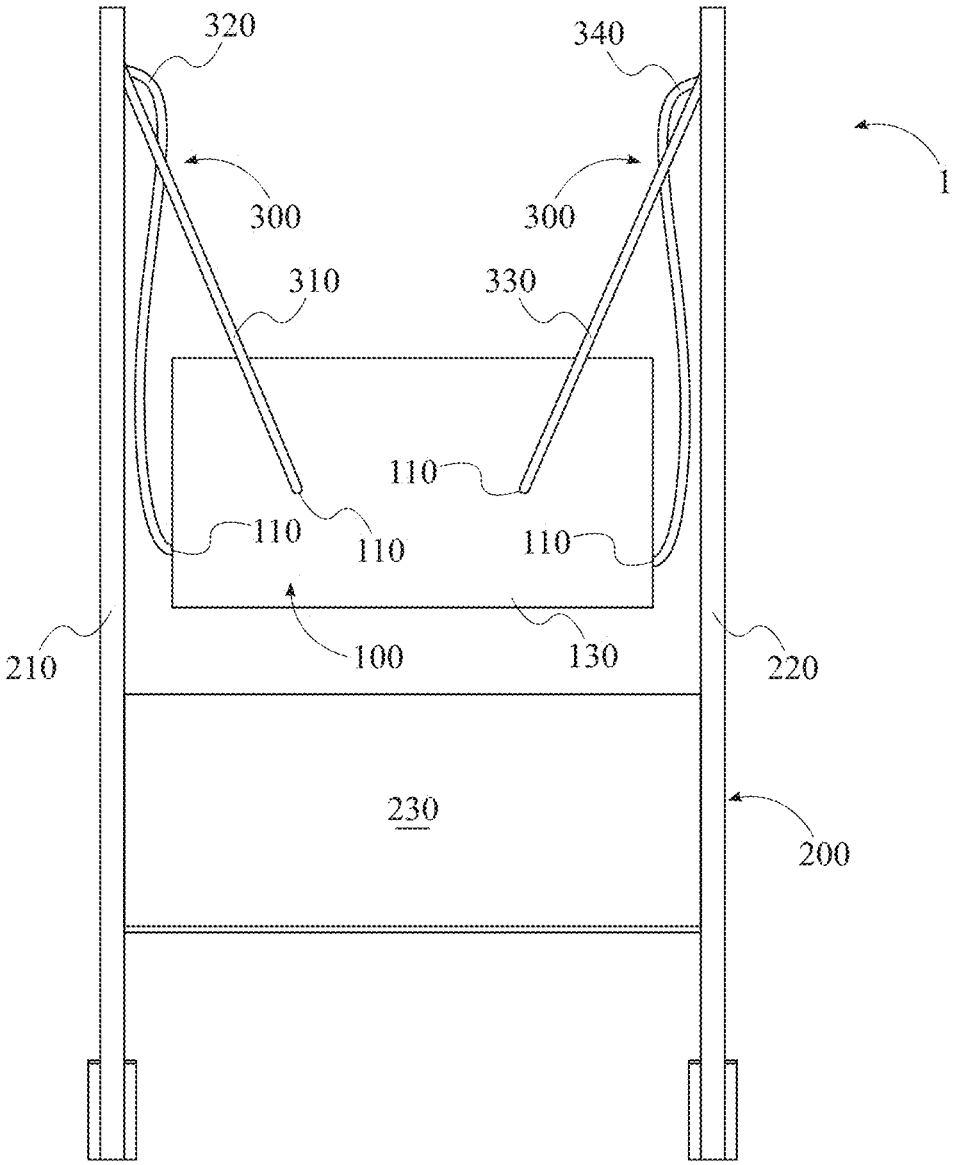
FIG. 3 is a rear view of the present invention.

As shown in FIG. 1 through FIG. 3, in the preferred embodiment of the present invention, the support structure 200 comprises a first support member 210, a second support member 220, and an at least one connecting support member 230. In the context of the present invention, the first support member 210 and the second support member 220, may be referred to herein as a left support structure and a right support structure. In the context of the present invention, the first support member 210 and the second support member 220 are mirrored structures, connected with the interposed at least one connecting support member 230, thereby creating a stable structure to support the weight and movement of the seat portion 100 of the present invention. In some embodiments of the present invention, the at least connecting support member 230 comprises a plurality of connecting support members wherein one of the connecting support members is positioned below the seat portion 100. In the preferred embodiment of the present invention, each of the first and second support members 210,220 comprises a bottom edge 211,221, a top edge 212,222, an at least one seat attachment mechanism 213, 223, and an at least one foot plate receiver 214,224.

The top edge 212,222 and the bottom edge 211,221 of each support member 210,220 are oppositely positioned from one another about each support member 210,220. In the preferred embodiment, the bottom edge 211,221 of each support member is greater in length than the top edge 212,222, keeping the sensory seat 1 from rocking back and forth when the seat portion 100 is moved. The at least one seat attachment mechanism 213,223 is a portion of the support structure 200 configured to receive and secure the plurality of connection members 300.

Furthermore, in the context of the present invention, the at least one foot plate receiver 214,224 is a groove, slot, and/or channel traversing inwardly from a frontmost portion of the first and second support members 210,220, for engaging and supporting a foot plate 400. In the preferred embodiment of the present invention, the at least one foot plate receiver 214,224 is cut into each of the first support member 210 and the second support member 220, in mirrored locations. Moreover, within the preferred embodiment of the present invention, the support members 210,220 comprise a plurality of foot plate receivers 214,224, spaced along a leading edge (frontmost portion of each aforementioned support member), wherein each foot plate receiver is parallel. Additionally, as shown in FIG. 1, FIG. 2, and FIG. 3, in the preferred embodiment of the present invention, each support member 210,220, the first support member 210 and the second support member 220, may comprise an A-shape wherein a triangular portion is cut from the center of the at least one support structure and a curved portion is cut from the bottom edge 211,221 of each support structure 201,220.

Figure 4:
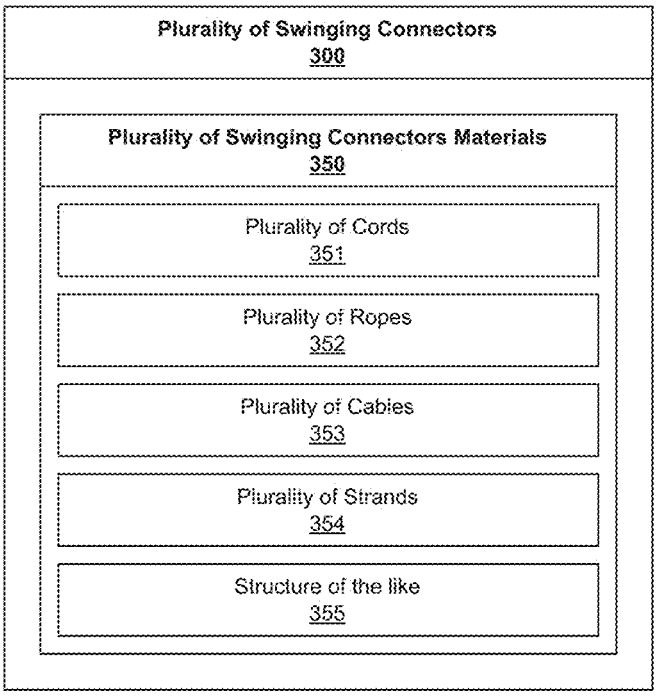
FIG. 4 is a diagram of the plurality of connection members (swinging connectors) of the present invention.

In the context of the present invention, the plurality of connection members 300 is a plurality of elongated strands configured to connect the seat portion 100 to the support structure 200. As shown in FIG. 4, the plurality connection members 300 is preferably composed of a material 350 selected from a plurality of cords 351, a plurality of ropes 352, a plurality of cables 353, a plurality of strands 353, or a combination of structures of the like 354. Moreover, within the preferred embodiment of the present invention, the plurality of connection members 300 comprises a first connection member 310, a second connection member 320, a third connection member 330, and a fourth connection member 340. In the context of the present invention, the first connection member 310 connects the first support member 210 to the seat back 130 of the seat portion 100; the second connection member 320 connects the first support member 210 to the left seat side 140; the third connection member 330 connects the second support member 220 to the seat back 130 of the seat portion 100; and the fourth connection member 340 connects the second support member 220 to the right seat side 150. The preferred arrangement of the plurality of connection members 300 leaves the seat portion 100 in a hanging position from the support structure 200, allowing the seat portion 100 to move multi-directionally relative to the support structure 200.

In the preferred embodiment, the present invention further comprises a foot plate 400. In the context of the present invention, the foot plate 400 is a panel that slides into a pair of corresponding (aligned) foot plate receivers 214,224. In such embodiments, the foot plate 400 offers a rigid supporting member for a user to rest their feet, thus providing a surface for those users that may not be able to reach the ground supporting the present invention. The foot plate 400 may be selectively slidably engaged within the at least one foot plate receiver 214,224 of the support structure 200. In the preferred embodiment, the foot plate 400 is engaged on one end with one of the plurality of grooves 214 of the first support structure 210 and is engaged on the opposite end with one of the plurality of grooves 224 of the second support structure 220. The foot plate 400 may be moved between the plurality of foot plate receiver 214,224 of the at least one foot plate receiver to arrange the foot plate 400 closer to or farther from the seat portion 100 depending upon the height of the user. In the preferred embodiment of the present invention, the foot plate 400 is positioned at an elevation lower than the seat portion 100.

As shown in FIG. 1 through FIG. 3, in some embodiments of the present invention, the support structure 200 may further comprise a plurality of base members 215,225, wherein the first support member 210 and the second support member 220 may comprise a first base member 215 and a second base member 225, respectively. In such embodiments, the base members 215,225 may extend outwardly in a forward direction from each support member 210,220, farther than the foot plate 400 to ensure that the present invention does not tip when a force is applied to the foot plate 400.

Further, in use, the user sits on the seat bottom 120 of the seat portion 100 with their lower back resting against the seat back 130. The foot plate 400 may be moved to the correct position prior to sitting in the seat portion 100 or once the user is seated. In some embodiments, the seat portion 100 may be moved relative to the support structure 200 by adjusting the plurality of connection members 300. Once the user is seated in the seat portion 100, they may move the seat portion 100 relative to the support structure 200 using their feet planted on the foot plate 400 or by shifting their weight within the seat portion 100.

Although the invention has been explained in relation to its preferred embodiment, it is to be understood that many other possible modifications and variations can be made without departing from the spirit and scope of the invention.

What is claimed is:

1. A sensory seat comprising:
a seat portion;
a support structure; and
a plurality of connection members;
wherein:
the seat portion of the present invention is suspended from the support structure, via the plurality of connection members;
each connection member being an elongated member possessing two distal ends, wherein one distal end is connected to the seat portion and the opposite distal end is connected to the support structure;
the plurality of connection members enabling the seat portion to move multi-directionally;
wherein the support structure comprises:
a first support member; and
a second support member;
wherein: the first support member and the second support member are mirrored structures; and the first support member and the second support member are arranged on opposite lateral sides of the seat portion; and
wherein the support structure comprises a plurality of foot plate receivers wherein: the first support member comprises an at least one foot plate receiver; the second support member comprises an at least one foot plate receiver; each foot plate receiver being a channel cut into a support member whereby the at least one foot plate receiver of the first support member is aligned with the at least one foot plate receiver of the second support member.

2. The sensory seat, as claimed in claim 1, further comprising a footplate wherein said footplate slidably engages into aligned foot plate receivers of the first support member and the second support member.

3. The sensory seat, as claimed in claim 1, further comprising a connecting support member wherein: the connecting support member is interposed between the first support member and the second support member.

4. The sensory seat, as claimed in claim 1, wherein the seat portion comprises:
a seat bottom;
a seat back;
a left seat side; and
a right seat side;
wherein:
the left seat side and the right seat side are each connected perpendicular to the seat bottom, extending parallel to one another away from the seat bottom; and
the seat back is connected to the seat bottom, the left seat side, and the right seat side, creating a partially enclosed basket structure.

5. The sensory seat, as claimed in claim 1,
wherein each of the first and second support members, comprises a bottom edge and a top edge, wherein:
the top edge and the bottom edge are oppositely positioned from one another about each support member; and the bottom edge comprises a greater length than the top edge.

6. The sensory seat, as claimed in claim 5, further comprising a plurality of base members, wherein each of the support members comprise one base member extending outwardly in a forward direction from the bottom edge of each support member.

7. The sensory seat, as claimed in claim 1, wherein the plurality of connection members are composed of at least one of the following selected from the group consisting of: a plurality of cords, a plurality of ropes, a plurality of cables and a plurality of strands.

8. A sensory seat comprising:
a seat portion;
a support structure;
a plurality of connection members; and
a foot plate;
wherein:
the seat portion of the present invention is suspended from the support structure, via the plurality of connection members;
each connection member being an elongated member possessing two distal ends, wherein one distal end is connected to the seat portion and the opposite distal end is connected to the support structure;
the plurality of connection members enabling the seat portion to move multi-directionally; and
the foot plate is slidably engaged with the support structure at an elevation lower than the seat portion.

9. The sensory seat, as claimed in claim 8, wherein the support structure comprises:
a first support member; and
a second support member;
wherein:
the first support member and the second support member are mirrored structures;

the first support member and the second support member are arranged on opposite lateral sides of the seat portion; and the foot plate is interposed between the first and second support members.

10. The sensory seat, as claimed in claim 9, further comprising a connecting support member wherein:

the connecting support member is interposed between the first support member and the second support member.

11. The sensory seat, as claimed in claim 10, wherein the support structure comprises a plurality of foot plate receivers wherein:

the first support member comprises an at least one foot plate receiver;

the second support member comprises an at least one foot plate receiver;

each foot plate receiver being a channel cut into a support member whereby the at least one foot plate receiver of the first support member is aligned with the at least one foot plate receiver of the second support member; and the foot plate slides into aligned foot plate receivers of each of the first and second support members.

12. The sensory seat, as claimed in claim 11, wherein the seat portion comprises:

a seat bottom;

a seat back;

a left seat side; and a right seat side;

wherein:

the left seat side and the right seat side are each connected perpendicular to the seat bottom, extending parallel to one another away from the seat bottom; and the seat back is connected to the seat bottom, the left seat side, and the right seat side, creating a partially enclosed basket structure.

13. The sensory seat, as claimed in claim 8, wherein each of the first and second support members, comprises a bottom edge and a top edge, wherein:

the top edge and the bottom edge are oppositely positioned from one another about each support member; and the bottom edge comprises a greater length than the top edge.

14. The sensory seat, as claimed in claim 13, further comprising a plurality of base members, wherein each of the support members comprise one base member extending outwardly in a forward direction from the bottom edge of each support member.

15. The sensory seat, as claimed in claim 12, wherein the plurality of connection members is composed of at least one of the following selected from the group consisting of: a plurality of cords, a plurality of ropes, a plurality of cables and a plurality of strands.

16. A sensory seat comprising:

a seat portion;

a support structure comprising a first support member and a second support member;

a plurality of connection members; and a foot plate; wherein:

the seat portion of the present invention is suspended from the support structure, via the plurality of connection members; each of the first support member and the second support member comprise at least one foot plate receiver;

each foot plate receiver being a channel cut into a support member whereby the at least one foot plate receiver of the first support member is aligned with the at least one foot plate receiver of the second support member each connection member being an elongated member possessing two distal ends, wherein one distal end is connected to the seat portion and the opposite distal end is connected to the support structure; the plurality of connection members enabling the seat portion to move multi-directionally; and the foot plate is slidably inserted into aligned foot plate receivers of the first support member and the second support member.

17. The sensory seat, as claimed in claim 16, wherein the plurality of connection members is composed of at least one of the following selected from the group consisting of: a plurality of cords, a plurality of ropes, a plurality of cables and a plurality of strands.

18. The sensory seat, as claimed in claim 17, wherein each of the support members, the first and second support members, comprise a bottom edge and a top edge wherein:

the top edge and the bottom edge are oppositely positioned from one another about each support member;

the bottom edge comprises a greater length than the top edge; and a base member extends outwardly in a forward direction from the bottom edge of each support member.

* * * * *